US007311368B2

(12) United States Patent
Kawakami

(10) Patent No.: US 7,311,368 B2
(45) Date of Patent: Dec. 25, 2007

(54) PRINTING APPARATUS, PRINTING METHOD AND PROGRAM

(75) Inventor: Kazuhisa Kawakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 10/885,585

(22) Filed: Jul. 8, 2004

(65) Prior Publication Data

US 2005/0012764 A1 Jan. 20, 2005

(30) Foreign Application Priority Data

Jul. 17, 2003 (JP) ..... 2003-276268

(51) Int. Cl.
*B41J 29/38* (2006.01)

(52) U.S. Cl. ..... 347/5; 347/6

(58) Field of Classification Search ..... 347/5, 347/6, 7

See application file for complete search history.

(56) References Cited

U.S. PATENT DOCUMENTS 5,742,301 A 4/1998 Ikeda
5,764,263 A * 6/1998 Lin ..... 347/101
6,012,809 A * 1/2000 Ikeda et al. ..... 347/101
6,467,896 B2 * 10/2002 Meyer et al. ..... 347/101
6,568,780 B2 * 5/2003 Schantz et al. ..... 347/14
6,752,481 B1 * 6/2004 Takahashi et al. ..... 347/9
7,083,248 B2 * 8/2006 Tajika et al. ..... 347/16
2002/0122103 A1 9/2002 Yamamoto et al.
2004/0095406 A1 * 5/2004 Uchida ..... 347/16
2005/0073535 A1 * 4/2005 Seki et al. ..... 347/5

FOREIGN PATENT DOCUMENTS

JP 7-314734 12/1995
JP 9-254376 9/1997

OTHER PUBLICATIONS

Offical Note Of Rejection for a corresponding Japanese application; Mailing date Dec. 15, 2006 corresponding to application No. 2003-276268; This has been provided by applicant on Jan. 16, 2007 and therefore has been scanned into IFW but failed to be properly cited for consideration.*

* cited by examiner

*Primary Examiner*—Stephen Meier
*Assistant Examiner*—Rene Garcia, Jr.
(74) *Attorney, Agent, or Firm*—Fitzpatrick, Cella, Harper & Scinto

(57) ABSTRACT

Printing of an image onto a printing medium is effected such that applied ink materials do not rub off. In the event of a printing mode in which the surface printed with an image is subject to rubbing, the kinds of ink used are limited so that the amount of pigment applied to printing image at least for a part of the side of the printing medium is decreased.

14 Claims, 4 Drawing Sheets

PRINTING APPARATUS, PRINTING METHOD AND PROGRAM

This application claims priority from Japanese Patent Application No. 2003-276268 filed Jul. 17, 2003, which is incorporated hereinto by reference.

BACKGROUND OF THE INVENTION

1. Field of the Invention

This invention relates to a printing apparatus, a printing method and program, for printing, by use of plural kinds of inks, image onto a printing medium, in plural printing modes including at least a double-sided printing mode in which images are printed on both sides of the printing medium, the plural number of kinds of inks including at least one kind of pigmented ink and at least one kind of dye ink.

2. Description of the Related Art

Conventionally, printing apparatuses configured as printers or copying machines are constructed to print image on a printing material (hereafter called "printing medium") in response to printing information. These printing apparatuses can be classified in accordance with their respective printing methods, such as inkjet printing, wire dot printing, thermal transfer imaging, and laser beam printing. Printing apparatus by using inkjet printing method (hereafter called "inkjet printing apparatus") print image by ejecting ink droplets from a printing means (hereafter called "printing head") onto the printing medium, and have advantages such as an ease of making the printing apparatus compact, a capability of high resolution image in high speed printing, a lower running cost, a lower noise due to being non-impact printing, and an ease of color image printing by using a large number of color inks.

Inks used for such inkjet printing apparatuses have conventionally been dye inks, which are produced by various water-soluble dyes dissolved in either water or a mixture of water and organic solvents. However, images printed by dye inks are somewhat inferior in image fastness such as light-fastness.

There has now come to be used pigmented ink, which is produced by dissolving the pigment dispersion liquid wherein a pigment is dispersed in a polymer dispersant. The characteristic of the pigmented ink is superior to the dye ink in image fastness such as water fastness. Since pigments have larger particle size of coloring agent than that of dyes, they are difficult to penetrate into the fibers of the printing medium such as plain paper, and stay near the surface thereof. As a result, the printing density increases, and the penetration to surrounding area becomes less, thus the boundaries of image are clearly printed. Currently, however, since pigmented inks other than black are somewhat inferior to the dye inks in terms of coloring ability many of ink jet printing apparatuses apply pigmented ink only for black ink, and apply dye inks for color inks such as cyan, magenta, and yellow.

In the meantime, in recent years there have increasingly become popular the ecological movements, and as a part of which, in view of preserving paper resources, printing on both sides of a printing medium (double-sided printing mode) is required of printing apparatuses.

Published references for such double-sided printing mode are available. For example, Japanese Patent Application Laid-open No.7-314734 (1995) in which disclosed is a countermeasure to suppress a see-through of the image printed on back side of a printing medium in the double-sided printing mode in which printing is effected to both sides of the printing medium. More specifically, a printing in a lower printing density in the double-sided printing mode than in the single-sided printing mode is disclosed therein.

Incidentally, since the pigmented inks are fixed near the surface of the printing medium, a see-through does not occur so much, if a double-sided printing is done. However, because the pigmented ink is inferior to the dye ink in abrasion resistance, the pigmented ink is subject to rubbing of in the double-sided printing mode.

Specifically because, in the double-sided printing mode, the printing medium is turned over after being printed on the front side thereof and transported with the printed side while being kept in contact with the transport route, the pigmented ink on the printed surface tend to be rubbed off. Therefore, a countermeasure is required to restrain such rubbed off of the pigmented ink for the double-sided printing mode using the pigmented ink.

However, the aforementioned Japanese Patent Application Laid-open No.7-314734 (1995) discloses neither a double-sided printing mode by using the pigmented inks, nor a method to limit an abrasion of the pigmented inks in the double-sided printing mode. Furthermore, Japanese Patent Application Laid-open No.7-314734 (1995) does not disclose a printing feature by using both the pigmented ink and the dye ink, nor does it disclose specifically a preferable double-sided printing mode using both the pigmented ink and the dye ink. Consequently, it does not disclose any method to restrain a rubbing off of the pigmented ink in a double-sided printing mode using both the pigmented ink and the dye ink.

SUMMARY OF THE INVENTION

The purpose of this invention, in executing the double-sided printing using the pigmented ink and the dye ink, is to provide a printing apparatus, a printing method and program, which best enable preventing any ink rubbing off and restrain contaminations on the printing medium and the interior of the printing apparatus.

In the first aspect of the present invention, there is provided a printing apparatus for printing an image onto a printing medium by using at least either a pigmented ink containing a pigment or a dye ink containing a dye, comprising:

printing control means capable of executing a single-sided printing mode effecting printing onto one side of the printing medium and a double-sided printing mode effecting printing onto both sides of the printing medium, wherein in the event of executing the double-sided printing mode, the printing control means effects printing onto at least one side on which the printing is effected first out of both sides of the printing medium by using only the dye ink instead of the pigmented ink.

In the second aspect of the present invention, there is provided a printing apparatus for printing an image on a printing medium by using at least either a pigmented ink containing a pigment or a dye ink containing a dye, comprising:

printing control means capable of executing a single-sided printing mode effecting printing onto one side of the printing medium and a double-sided printing mode effecting printing onto both sides of the printing medium, wherein in the event of executing the double-sided printing mode, the printing control means printing onto at least a specific part of the side on which the printing is effected first, out of both sides of the printing medium by using only the dye ink instead of the pigmented ink.

In the third aspect of the present invention, there is provided a printing apparatus for printing an image onto a printing medium by using at least either a pigmented ink containing a pigment or a dye ink containing a dye, comprising:

printing control means capable of executing a single-sided printing mode effecting printing onto one side of the printing medium and a double-sided printing mode effecting printing onto both sides of the printing medium, wherein in the event of executing the double-sided printing mode, the printing control means effects printing by using the dye ink as substitute for a part of the image which is supposed to be printed by using the pigmented ink.

In the fourth aspect of the present invention, there is provided a printing apparatus for printing an image on a printing medium by using at least either a pigmented ink containing a pigment or a dye ink containing a dye, comprising:

printing control means capable of executing a single-sided printing mode effecting printing onto one side of the printing medium and a double-sided printing mode effecting printing onto both sides of the printing medium, wherein in the event of the double-sided printing mode, the printing control means effects printing onto at least the side on which the printing is effected first by not reducing the amount of the dye ink as compared to the single-sided printing mode, while by reducing the amount of the pigmented ink as compared to the single-sided printing mode.

In the fifth aspect of the present invention, there is provided a printing method of printing an image onto a printing medium by using at least either a pigmented ink containing a pigment or a dye ink containing a dye, comprising the steps of:

a selection step in which a printing mode is selected from either a single-sided printing mode effecting printing onto one side of the printing medium or a double-sided printing mode effecting printing onto both sides of the printing medium;

a data creation step in which an image data is created for effecting printing onto at least the side of the printing medium on which the printing is effected first, out of both sides of the printing medium, with limiting a use of the pigmented ink when the double-sided printing mode is selected in the selection step, and in which an image data is created for printing without limiting the use of the pigmented ink when the single-sided printing mode is selected in the selection step; and a printing step in which printing onto the printing medium is performed based on the image data created in the data creation step.

In the sixth aspect of the present invention, there is provided a printing method of printing an image on a printing medium by using at least either a pigmented ink containing a pigment or a dye ink containing a dye, comprising the steps of:

a selection step in which a printing mode is selected from either a single-sided printing mode effecting printing onto one side of the printing medium or a double-sided printing mode effecting printing onto both sides of the printing medium;

a data creation step in which an image data is created for printing for at least a specific part of the side of the printing medium on which the printing is effected first, out of both sides of the printing medium, with limiting a use of the pigmented ink when the double-sided printing mode is selected in the selection step, and in which an image data is created for printing without limiting the use of the pigmented ink when the single-sided printing mode is selected in the selection step; and a printing step in which printing onto the printing medium is performed based on the image data created in the data creation step.

In the seventh aspect of the present invention, there is provided a printing method of printing an image onto printing medium by using at least either a pigmented ink containing a pigment or a dye ink containing a dye, comprising the steps of:

a selection step in which a printing mode is selected from either a single-sided printing mode effecting printing onto one side of the printing medium or a double-sided printing mode effecting printing onto both sides of the printing medium;

a data creation step in which an image data is created for printing for a part of the image, which is supposed to be printed by using the pigmented ink, by using the dye ink as substitute when the double-sided printing mode is selected in the selection step, and in which an image data is created for printing without using the dye ink as substitute for a part of the image which is supposed to be printed by using the pigmented ink when the single-sided printing mode is selected in the selection step; and a printing step in which printing onto the printing medium is performed based on the image data created in the data creation step.

In the eighth aspect of the present invention, there is provided a program executable in a computer to create an image data to be supplied to a printing apparatus, the printing apparatus being adapted to print an image onto a printing medium by using at least either a pigmented ink containing a pigment or a dye ink containing a dye, wherein the program includes a data creation step in which a data is created in response to a printing mode selected out of a single-sided printing mode effecting printing onto one side of the printing medium and a double-sided printing mode effecting printing onto both sides of the printing medium, whereby during the data creation step, an image data is created for effecting printing onto at least the side on which the printing is effected first out of both sides of the printing medium by using only the dye ink instead of the pigmented ink when the double-sided printing mode is selected.

In the ninth aspect of the present invention, there is provided a program executable in a computer to create an image data to be supplied to a printing apparatus, the printing apparatus being adapted to print an image onto a printing medium by using at least either a pigmented ink containing a pigment or a dye ink containing a dye, wherein the program includes a data creation step in which a data is created in response to a printing mode selected out of a single-sided printing mode effecting printing onto one side of the printing medium and a double-sided printing mode effecting printing onto both sides of the printing medium, whereby during the data creation step, an image data is created for printing for at least a specific part of the side on which the printing is effected first of the printing medium by using only the dye ink instead of the pigmented ink when the double-sided printing mode is selected.

In the tenth aspect of the present invention, there is provided a program executable in a computer to create an image data to be supplied to a printing apparatus, the printing apparatus being adapted to print an image onto a printing medium by using at least either a pigmented ink containing a pigment or a dye ink containing a dye, wherein the program including a data creation step in which a data is created in response to a printing mode selected out of a single-sided printing mode effecting printing onto one side of the printing medium and a double-sided printing mode effecting printing onto both sides of the printing medium, whereby during the data creation step, an image data is created for printing for a part of the image, which is supposed to be printed by using the pigmented ink, by using the dye ink as substitute when the double-sided printing mode is selected, and in which an image data is created for printing without using the dye ink as substitute for a part of the image which is supposed to be printed by using the pigmented ink when the single-sided printing mode is selected.

The invention enables to suppress a printing density reduction in the double-sided printing mode using the pigmented ink and the dye ink, while reducing a printed ink rubbing off, thereby lowering contaminations on the interior of printing apparatus and the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
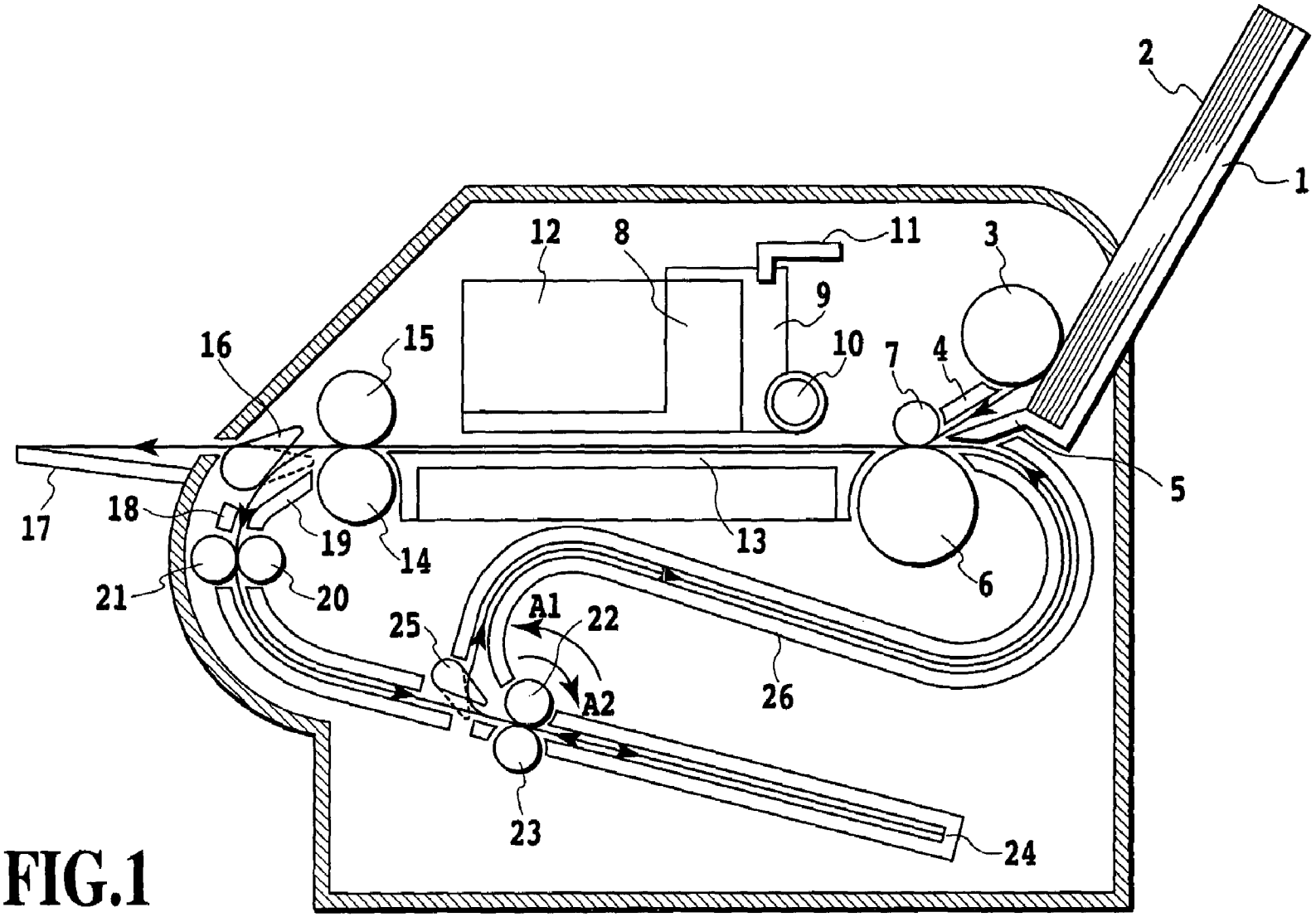
FIG. 1 is a sectional view for explaining a schematic construction of the relevant part of an inkjet printing apparatus relating to the embodiment 1 of the present invention.

Referring to the drawing, embodiments of the present invention are explained as follows.

It is noted that in this specification, a "front side" of the printing sheet refers to the side, which is printed first, while a "back side" of the printing sheet refers to the side, which is printed second.

First Embodiment

FIG. 1 illustrates a sectional view of an example of inkjet printing apparatus construction related to the present invention.

In FIG. 1, reference numeral 1 denotes a sheet supply stacker capable of stacking a large number of printing sheets 2 which are the printing media. The printing sheets 2 stacked in the sheet supply stacker 1 are separated sheet by sheet at the top of the stack by feed roller 3 driven by feed motor 106 (referring to FIG. 2), and one sheet at a time is fed to a printing sheet transport. The printing sheet 2, passing through a space between an upper guide 4 and a lower guide 5 of the printing sheet transport, becomes pinched between a transport roller 6, driven by a transport motor 107 (referring to FIG. 2), and a pinch roller 7, and is transported to a printing position which faces against a printing head. The transport roller 6 feeds the printing sheet 2 in a sub-scanning direction, which is toward the left in FIG. 1, in predetermined increments. At the printing position, the printing head 8, which is the means to print images onto the printing sheet 2, is mounted detachably onto a carriage 9. The carriage 9 is supported by a guide shaft 10 and a guide rail 11 in such a way possible to travel in a main scanning direction. The main scanning direction is perpendicular to the sub-scanning direction, in the front-back direction of the page where FIG. 1 is drawn and in parallel with the surface of the printing sheet 2. The carriage 9 is reciprocated in the main scanning direction driven by a carriage motor 108 (referring to FIG. 2).

The printing head 8 is the inkjet printing head, which is able to eject ink droplets from ink ejection openings. An ink ejection method can adopt from various methods utilizing ejection energy generation means such as an electro-thermal transducer or a piezo-electric actuator. In a case where the electro-thermal transducer is used, the electro-thermal transducer is installed in an ink supply passage as a heat generation resistor, ink is boiled by heat generation energy of the electro-thermal transducer, and the resultant foaming energy is utilized to eject ink from the ink ejection opening. On the carriage 9, an ink tank 12 is mounted, along with the printing head 8, for supplying ink to the printing head 8. The ink tank 12 is detachable from the printing head 8. Therefore, when the ink in the ink tank 12 is depleted in a printing operation, replacing the ink tank 12 will enable a continuation of the printing operation. The ink tank 12 is stored with black ink (K ink) and color inks such as cyan (C ink), magenta (M ink) and yellow (Y ink), and these inks will be ejected from the ejection openings of the printing head 8.

The printing head 8 can either be one integrated printing head formed with the ink ejection openings corresponding to each color ink, or consisting of a plurality of printing heads. The plurality of printing heads can be formed with the ink ejection openings corresponding to each color ink, or formed with the ink ejection openings corresponding to a plurality of color inks, respectively. And, the ink tank 12 can either be one integrated body equipped with specific reservoir for black and each color such as cyan, magenta and yellow, or separate tanks of which one (black ink tank) being for black and the other (color ink tank) being all applicable colors. Further, the color ink tank can either be one integrated body equipped with specific reservoir for each color such as cyan, magenta and yellow, or separate bodies each equipped with specific color ink reservoir. And, the ink tank 12 can be either detachable from the printing head 8, or integrated with the printing head 8. Further, the printing head 8 can also be integrated with the carriage 9.

In this example, there are used a pigmented ink for black ink and dye inks for cyan, magenta and yellow inks as color inks. There can be produced the pigmented ink by dissolving the pigment dispersion into water-soluble solvent wherein a pigment is dispersed in polymer dispersant. The dye inks on the other hand can be produced by various water-soluble dyes dissolved in either water or a mixture of water and organic solvents. As mentioned above, images printed with the dye inks are somewhat inferior in image robustness such as light-fastness; and the characteristic of the pigmented ink is superior to the dye ink in image robustness such as water resistance. Also noted is that the pigment has larger coloring particles than a dye so that it stays near the surface of a printing medium such as plain paper instead of penetrating deeper into its fibrous construction. This makes the image density higher, permeation to surrounding areas less, and thereby the image border highly distinctively conspicuous.

At the printing position, a platen 13, which is mounted in a position opposite to the printing head 8, supports the printing sheet 2 on the back surface as shown in FIG. 1. And at the printing position, the printing operation in which the printing head 8 ejects ink droplets as it travels in the main scanning direction, and the feeding operation in which the printing sheet 2 is fed by each predetermined increment in the sub-scanning direction, are alternately repetitively effected and thereby images are printed in sequence on a upper side surface of the printing sheet 2 in FIG. 1. The printing sheet 2 with images printed at the printing position becomes pinched between an exit roller 14 and a spur wheel 15 and is transported leftward as indicated in FIG. 1. The printing sheet 2 is sent either to an exit stacker 17 or a double-sided sheet inversion portion, in accordance with the position of an exit flapper 16.

In a single-sided printing mode printing image only on one side of the printing sheet 2, the exit flapper 16 moves to the position as indicated by the dotted lines in FIG. 1. The printing sheet 2 printed on the front side is thereby guided by the exit flapper 16 and sent out onto the exit stacker 17, thus being stacked in sequence.

On the other hand, in a double-sided printing mode of printing images on both sides of the printing sheet 2, the exit flapper 16 orients itself as indicated by the solid lines in FIG. 1. The printing sheet 2 printed on the front side is thereby guided by the exit flapper 16 and transported to the space formed between an outer inversion guide 18 and an inner inversion guide 19 of the double-sided sheet inversion portion. The printing sheet 2 subsequently becomes pinched between a midway roller 20 and a midway spur wheel 21, and is transported to raise an inversion flapper 25 to the position illustrated by solid lines in FIG. 1. The printing sheet 2 then becomes pinched between a reversible inversion roller 22 in its forward rotation as indicated by arrow A1, and an inversion spur wheel 23, and is transported to an inversion stacker 24. When the printing sheet 2 is transported to the inversion stacker 24, some part of the rear end of the printing sheet 2 is pinched between the inversion roller 22 and the inversion spur wheel 23. Subsequently, the reverse rotation of the inversion roller 22, in arrow A2 direction as indicated, causes the exit flapper 16 to move to the position as indicated by the dotted lines, and inversion flapper 25 drops down on its own weight to the position indicated by the dotted lines in FIG. 1. As a consequence, the printing sheet 2 which was transported into the inversion stacker 24 is now guided by the inversion flapper 25 in the position indicated by the dotted lines in FIG. 1 and is led to a substantially S-shaped pathway 26. The printing sheet 2 is transported through the pathway 26 to become pinched again between the transport roller 6 and the pinch roller 7 to be fed to the printing position.

When the printing sheet 2 goes through the pathway 26, its top and bottom surfaces in FIG. 1 are turned over. On the printing sheet 2 being turned over, image is printed again by the printing head 8. Then the printing sheet 2, after being printed on both sides thereof, becomes pinched by the exit roller 14 and the spur wheel 15, is guided by the exit flapper 16 in the position indicated by the dotted lines in FIG. 1, is then transported out onto the exit stacker 17 and stacked in sequence.

For the double-sided printing mode, as described later, in consideration of a side of the printing sheet 2, on which image is printed first (hereafter called "front side"), coming in contact with various rollers, etc., a printing is performed so as to best minimize an abrasion of ink from the surface thereof. Also in the double-sided printing mode, as described above, the printing sheet 2 is turned over after being printed on the front side thereof and then printed on a reverse side thereof (hereafter called "back side").

Figure 2:
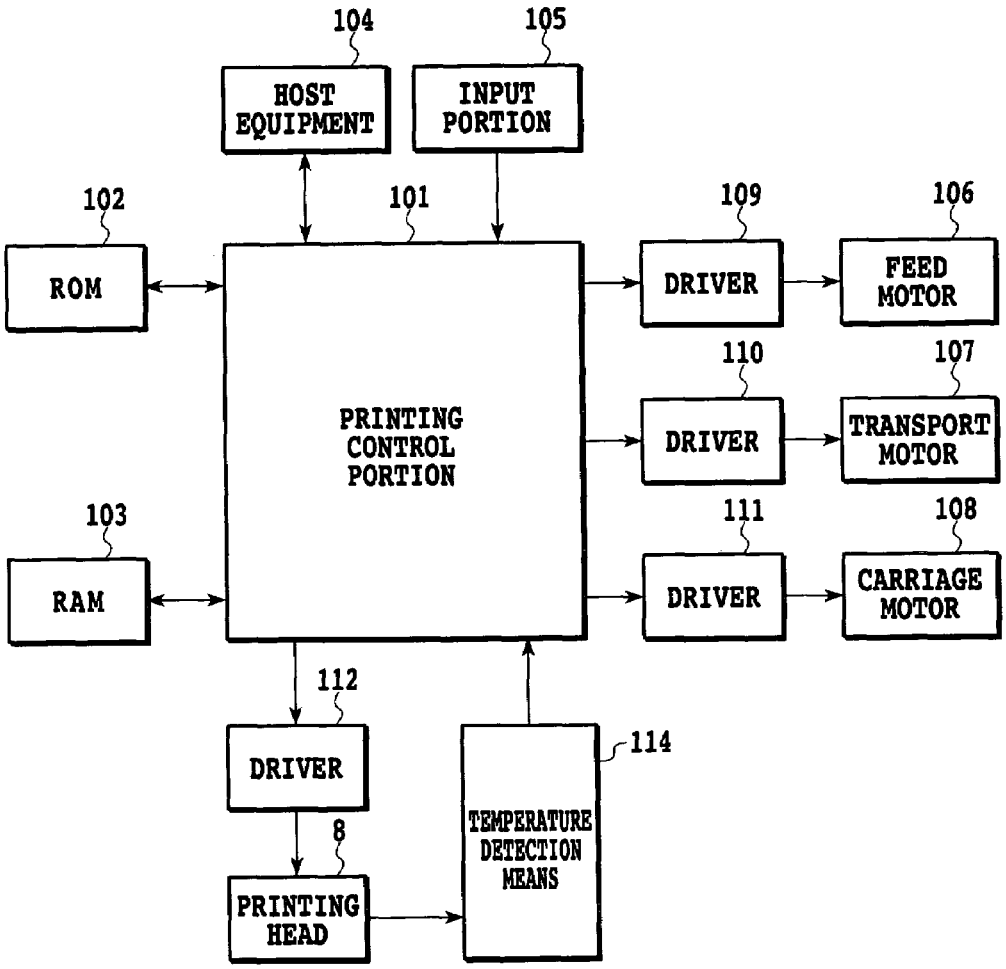
FIG. 2 is a block diagram of the control circuit for the inkjet printing apparatus shown in FIG. 1.

FIG. 2 indicates a schematic block diagram of a control circuit for the inkjet printing apparatus illustrated in FIG. 1. Reference numeral 101 denotes a printing control portion to control the printing operations for the inkjet printing apparatus relating to this example. Reference numeral 102 denotes a ROM as a memory means to store programs to be executed by the printing control portion 101. Reference numeral 103 denotes a RAM as a memory means to store temporarily the data for printing images, which are sent from a host equipment 104. Reference numeral 105 denotes an input portion for giving instructions, such as various printing mode selections, to the printing control portion 101. The input portion 105, in more specific, is devised in such a manner as to instruct the double-sided printing mode. Reference numeral 106 denotes a sheet supply motor to perform a feeding operation of the printing sheet 2 starting from the sheet supply stacker 1; reference numeral 107 denotes a transport motor to perform a transport operation of the printing sheet 2; reference numeral 108 denotes a carriage motor to move carriage 9 in the main scanning direction; reference numerals 109, 110 and 111 denote respective drivers for these motors. Reference numeral 112 denotes a printing head driver to drive the printing head 8 in response to printing signals; and reference numeral 114 denotes temperature detection means to detect temperature of the printing head 8. The printing control portion 101 receives detection signals from the temperature detection means 114, sends modified printing signals in response to the detection signal thereof to the printing head driver 112, and thereby causes the printing head 8 to eject ink droplets stably taking into account the temperature of the printing head 8.

Figure 3:
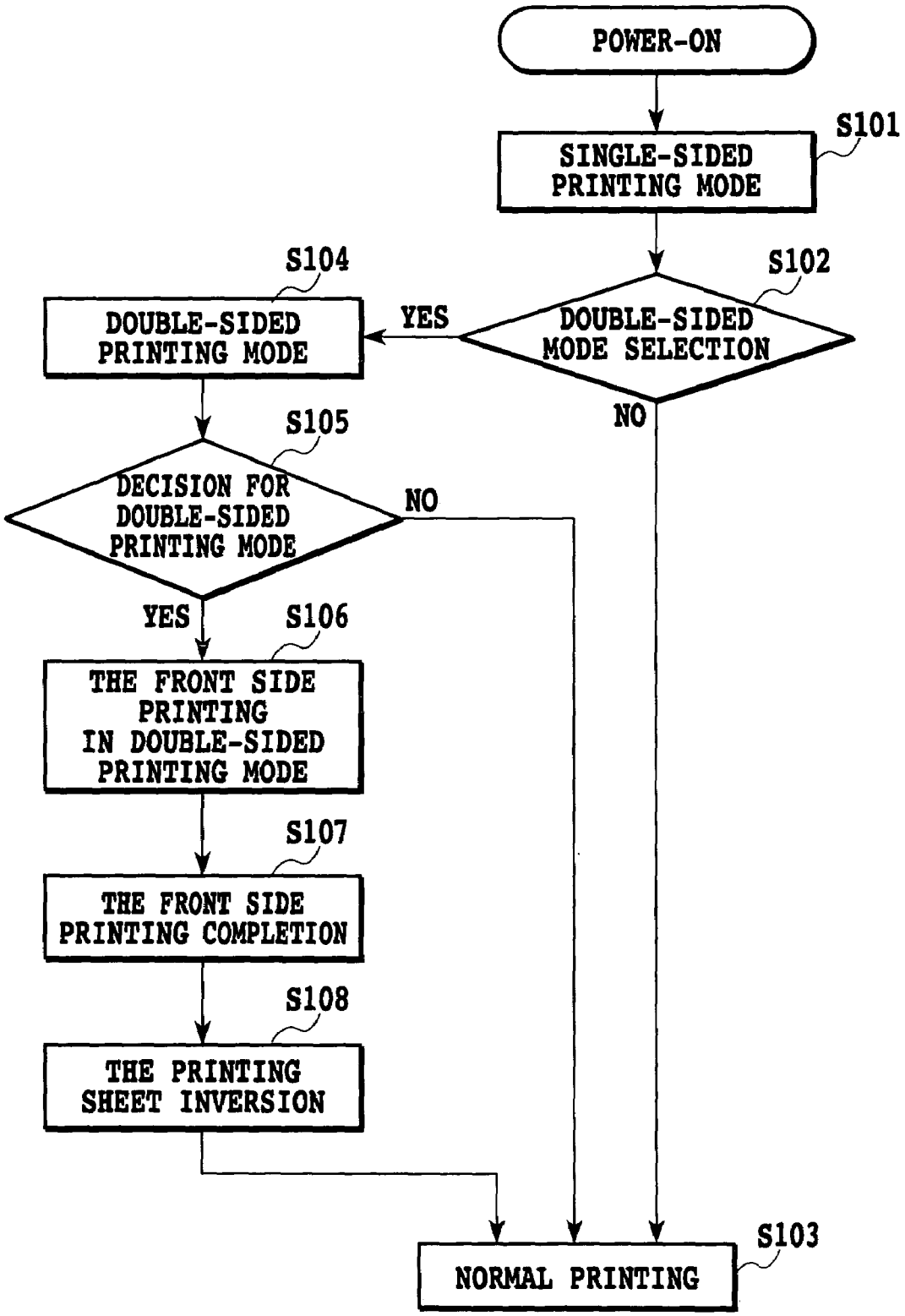
FIG. 3 is a flow chart for explaining the control sequence when selecting the printing modes applicable to the first embodiment of the present invention.

Now referring to FIG. 3, printing operation procedures or processes for the single-sided and the double-sided printing modes relating to the invention are hereby explained.

Upon turning on the power on for the printing apparatus, in the step S101 the single-sided printing more is automatically set for the printing apparatus. Subsequently, the step S102 makes judgment as to whether or not the double-sided printing mode was selected through the input portion 105. If the double-sided printing mode was not selected in the step S102, then the process proceeds to the step S103. Then there is performed a normal printing operation with preset printing features such as HS (high speed) or HQ (high quality) in the single-sided printing mode. In this case the pigmented black ink is possibly used depending upon the kind of the printing sheet 2 or the printing information. In other words, the pigmented black ink and the dye color inks are used suitably in response to the printing image in the single-sided printing mode. There can be cases in which only the dye inks are used, or only the pigmented ink is used, or both the pigmented ink and the dye inks are used.

On the other hand, if the double-sided printing mode was selected in the step S102, then the process proceeds to the step S104, and the double-sided printing mode is set. In the subsequent step S105, however, it is made possible, through the input portion 105, to select the normal printing in the single-sided printing mode or the printing in the double-sided printing mode. If the double-sided printing mode is not selected in the step S105, then the process proceeds to the step S103, whereupon there is performed the normal printing operation with preset printing features such as HS (high speed) or HQ (high quality) in the single-sided printing mode.

If the double-sided printing mode is selected in the step S105, then the process proceeds to the step S106, and images are first printed on the front side of the printing sheet 2. In this case, no pigmented black ink is used irrespective of the kind of the printing sheet 2 or the printing information. For printing images in black, the printing is performed by so-called process black by using the dye color inks (cyan, magenta and yellow), in place of using pigmented black ink. Then, after effecting printing onto the front side of the printing sheet 2 (step S107), the printing sheet 2 is transported to the double-sided sheet inversion portion to invert the sheet (step S108) as mentioned above.

At this moment, the reason for using only the dye inks, instead of pigmented ink, to print on the front side of the printing sheet 2 in the double-sided printing mode is hereby explained. In the double-sided printing mode, the front side of the printing sheet 2, having been printed with images, are in contact with, and rubbed off or abraded by the various components and the transport roller, etc., in the double-sided sheet inversion portion. Under such condition in which the printing sheet surface is subject to rubbing or abrasion it is most probable for the pigmented ink to be rubbed off or abraded away if such an ink having a low abrasion resistance is used. Specifically, the pigment particles in the pigmented ink are larger than the dye particles so that they hardly penetrate deeper into the fibrous construction of printing medium such as the plain paper and instead stay nearby the surface thereof, and therefore tend to be rubbed off or abraded away when contacting with the rollers, etc. Once the pigment particles are rubbed off or abraded away, contaminations occur not only on the printing sheet but also in the interior of the printing apparatus. On the other hand, the dyes in dye inks tend to penetrate deeper into the fibrous construction of the printing sheet 2 it is hardly probable for them to be rubbed off or abraded away when contacting with the rollers, etc. Therefore, in this embodiment, only the dye inks, instead of pigmented black ink, are used to print on the front side of the printing sheet 2 in the double-sided printing mode.

Then, after the printing sheet 2 is inverted, the step S103 is initiated to print images on the backside thereof. When effecting printing onto the back side of the printing sheet 2, the pigmented black ink is used in response to the kind of the printing sheet 2 or the printing information. In other words, the normal printing is performed using the pigmented black ink with preset printing features such as HS or HQ.

Incidentally, the following are the reasons why a use of the pigmented ink is not limited in effecting printing onto the back side of the printing sheet 2 in the double-sided printing mode. Namely, after effecting printing onto the back side of the printing sheet 2, there is no sheet inversion operation, or abrasion on the back side by the rollers, etc., or images being rubbed off or abraded away if the pigmented ink is used. Due to these reasons it is possible to use both the dye inks and the pigmented ink in effecting printing onto the back side of the printing sheet 2.

In accordance with the first embodiment as described above, in the double-sided printing mode, the dye inks, instead of a pigmented ink, are used to print image on the front side of the printing sheet 2 which is liable to be abraded or rubbed off after the printing, whereas a use of the pigmented ink is not limited to print image on the back side of the printing sheet 2. As a result, it is able to print on each side of the printing sheet 2 in such a way as to prevent inks from being rubbed off or abraded away, keep the printed image density minimally lower, and thereby maintain the printed image at a high grade.

Second Embodiment

Figure 4:
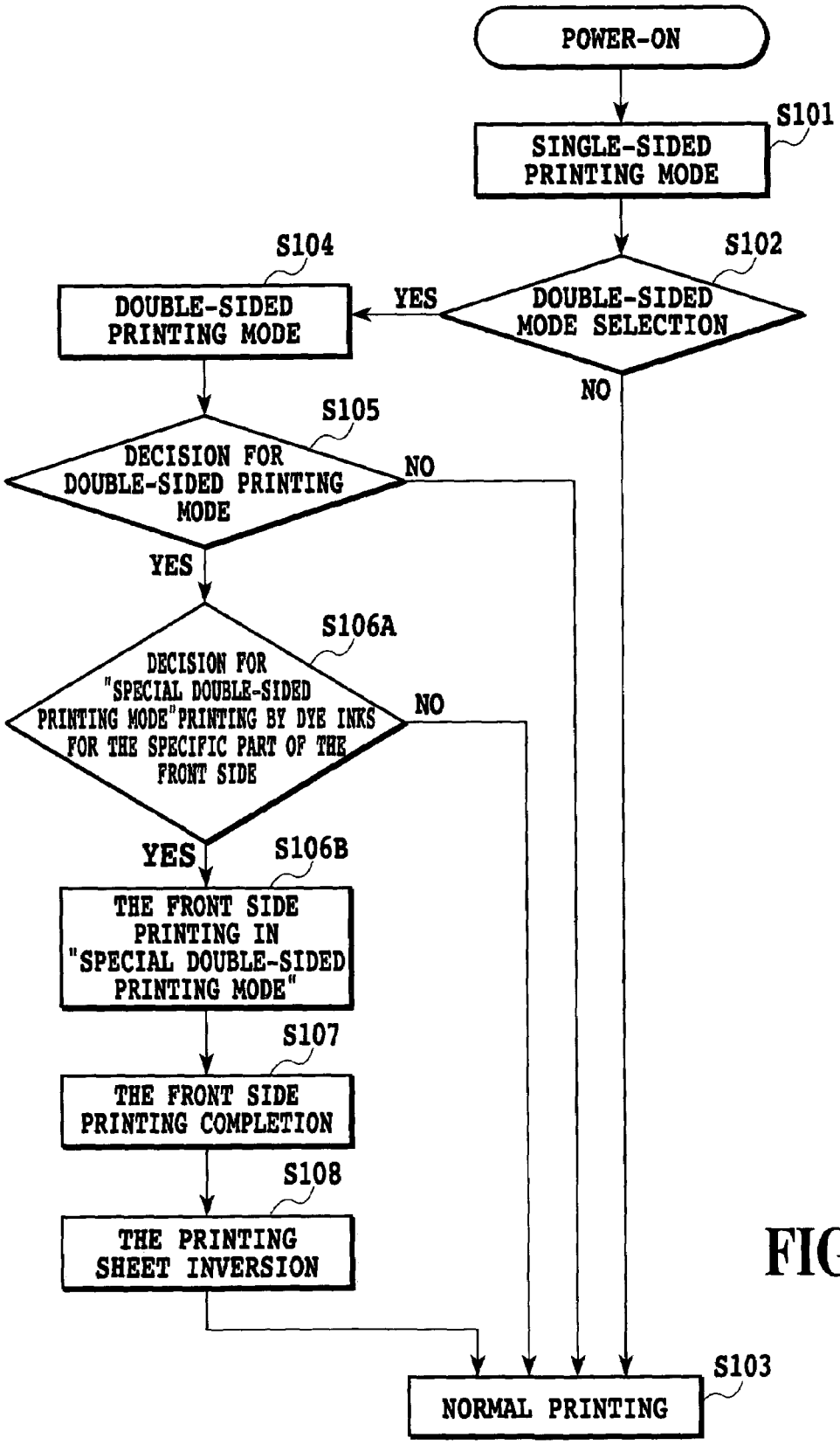
FIG. 4 is a flow chart for explaining the control sequence when selecting the printing modes applicable to the second embodiment of the present invention.

FIG. 4 is a flow chart to describe the printing operation applicable to the second embodiment 2 of the present invention. For those parts similar to the aforementioned FIG. 3, the same symbols are given with their descriptions omitted.

In the second embodiment, the difference from the first embodiment above is the addition of the step S106A. Namely, when effecting printing onto the front side of the printing sheet 2 in the double-sided printing mode, a selection is made as to whether or not dye inks shall only be used to print a specific part (including parts in contact with rollers) of the front side of the printing sheet 2, in consideration of the position on the front side coming in contact with the rollers, etc. Specifically, in the event of effecting printing onto the front side of the printing sheet 2, a decision is made (in the step S106A) as to whether a special double-sided printing mode (hereafter alternatively called "the secondary double-sided printing mode"), in which the printing is performed by using only the dye inks for the specific part as mentioned above, is selected or not. And, if the special double-sided printing mode is selected, image is printed by using only the dye inks, instead of pigmented ink, for the above-mentioned specific part; and image is printed by using both the pigmented and the dye inks for the parts other than the specific part (the unspecific part). It is noted that the specific part where printing is executed by using only the dye inks is the part, which is likely to come in contact with rollers, etc. Thus, by printing image without using pigmented ink only for the specific part where the rollers, etc., is likely to contact, it is made possible to prevent ink from being rubbed off or abraded away as a result of rollers, etc., coming in contact with.

It is noted that made possible for a user, through a user interface screen for example, to decide whether or not the printing shall be performed by using only the dye inks, instead of a pigmented ink, for the specific part of the front side of the printing sheet 2, namely a decision of as to whether or not selecting the special double-sided printing mode. Specifically, the user interface calculates, and indicates on the screen, the position of the specific part of the front side of the printing sheet 2 where the rollers, etc., are likely to contact, based on preprogrammed positional data of the double-sided sheet inversion portion and the transport rollers, etc. in the printing apparatus; and data of the printing sheet 2 such as the size. The user decides, based on the display content and its relation with the image to be printed, whether or not to select the special double-sided printing mode to print the specific, part without using pigmented ink, and accordingly inputs the result through the input portion 105. When the special double-sided printing mode is selected to print the specific part without using pigmented ink, proceeding to the step S106B is initiated and effecting printing onto the front side of the printing sheet 2 is performed in the "special double-sided printing mode" (step S106B). In other words, the specific part is printed by using only the dye inks, and the unspecific part is printed by using both the pigmented and the dye inks. On the other hand, if the special double-sided printing mode is not selected, then the normal printing is performed in the step S103.

An automatic programming can also be done to record the specific part without using pigmented ink at all times.

In accordance with the second embodiment as described above, because the printing is performed without using a pigmented ink for a part of the printing sheet where the ink tend to be rubbed off or abraded away (the specific part of the front side of printing sheet), it is able to suppress abrasion of the printed pigmented ink. And, because a printing is performed by using the pigmented ink for the unspecific part of the printing sheet, a reduction in printing density on the front side is less than that in the first embodiment.

Third Embodiment

The third embodiment comprises the double-sided printing mode (the first double-sided printing mode) as described in the first embodiment and the double-sided printing mode (the second double-sided printing mode) as described in the second embodiment wherein either of the two double-sided modes can be selected. It is noted that such selection of the double-sided printing mode is executed in the input portion 105 of the inkjet printing apparatus.

In the third embodiment the double-sided printing mode suitable to the user needs is enabled. Specifically, if the importance is given to suppress contaminations in the printing apparatus or on the printing sheet surface, the first double-sided printing mode is available, while if the importance is given to the printed image density on the printing sheet, then the second double-sided printing mode is available.

It is noted that, in the first double-sided printing mode, a non-uniform image quality of black colored areas otherwise formed by a mixture of K dots of the pigmented ink with C, M and Y dots of the dye inks does not occur, because the black colored areas on the front side of the printing sheet are formed only by C, M and Y dots of the dye inks. In other words, a better uniformity of black colored areas in the printed image is maintained for the front side of the printing sheet in the first double-sided printing mode. Contrary to the above, since the back side of the printing sheet is printed with the pigmented K ink, the image qualities of black between the front and back sides of the printing sheet are different from each other. On the other hand, in the second double-sided printing mode, since black colored areas of the printed image on the front side of the printing sheet are formed by a mixture of the pigmented K ink dots and the dye C-, M- and Y ink dots, the uniformity of image quality in black colored areas of the front side of the printing sheet are inferior to that of the above mentioned first double-sided printing mode. However, in the second double-sided printing mode, on the front side of the printing sheet, while the black colored area of the specific part is formed by only the dye C-, M- and Y dots, the black colored area of the unspecific part is formed by a mixture of the pigmented K ink dots and the dye C-, M- and Y ink dots, whereas, on the back side of the printing sheet, black colored areas are formed by the pigmented K ink dots. This makes the image qualities of the black colored areas between the front and the back sides of the printing sheet are similar to each other. Therefore, it is made possible to select the first double-sided printing mode if the uniformity of image quality in the black colored areas on the front side of the printing sheet is important, or alternatively the second double-sided printing mode if the similarity of image quality in the black colored areas between the front and the back sides of the printing sheet is important.

Fourth Embodiment

In the foregoing first embodiment through third embodiment, black colored area in the printed image is formed by a mixture (the process black) of the dye color ink dots (the dye C-, M- and Y color inks) across the entirety or for a part of the front side of the printing sheet. In this embodiment, such printing for black colored area by the process black is replaced with dye black ink.

Specifically, in the fourth embodiment the arrangement is made such that there is used, as a black ink, a dye black ink containing mainly a dye, in addition to using a pigmented black ink containing mainly a pigment. In this embodiment, an ink tank stored with a dye black ink and a printing head capable of ejecting the dye black ink stored in the ink tank are used, in addition to plural ink tanks (tanks storing the pigmented K ink, the dye C-, the dye M- and the dye Y inks) and plural printing heads (printing heads capable to eject the pigmented K ink, the dye C-, the dye M- and the dye Y inks).

And in the double-sided printing mode, only the dye black ink, in place of pigmented black ink, is used to print on the front side of the printing sheet; and the pigmented black ink is used to print on the back side of the printing sheet. Such arrangement enables not only to prevent the pigmented ink from being abraded off the surface of the printing sheet, but also enables to avoid degradation in image quality of black, or a semi-chromatic black in other words, due to a relative displacement of color dots, because there is no layer consisting of the C-, M- and Y color ink dots as in obtaining a process black. In the double-sided printing modes in which the amount of ejected ink tends to increase, a use of the process black further increases the amount of ejected ink. However, this embodiment also gains a benefit of reducing the total amount of ejected ink by use of the dye black ink as compared to the first embodiment.

Fifth Embodiment

In the above mentioned first and fourth embodiments, in the double-sided printing mode, only the dye inks, in place of a pigmented ink, are used to print on the front side of the printing sheet, while the pigmented ink is used to print on the back side. This accordingly necessitates switching from a use to a non-use of the pigmented ink between the front side and the back side printings for a printing sheet. Therefore, this embodiment comprises elimination of switching between a use and a non-use of pigmented ink by excluding a use of the pigmented ink in the double-sided printing mode.

Specifically, both the pigmented and the dye inks are used to print in the single-sided printing mode, while a use of the pigmented ink is restrained in the double-sided printing mode. In other words, printing is performed without using pigmented ink on either of the front side or the back side in the double-sided printing mode.

Such an arrangement, in the double-sided printing mode, not only prevents the pigmented ink from being abraded off the printing sheet, but also provides printings of black areas with the same image quality between the front and back sides of the printing sheet.

Sixth Embodiment

In the above mentioned first, fourth and embodiments, in the double-sided printing mode, a use of the pigmented ink, which is inferior in abrasion resistance, is restrained in printing at least on the front side of the printing sheet 2. However, it is made possible to suppress the extent of a pigment ink abrasion off the front side of the printing sheet by just reducing the amount of the pigmented ink usage in effecting printing onto the front side of the printing sheet, instead of altogether eliminating a use of the pigmented ink. In sum, it is merely required to lower the amount of the pigmented ink in effecting printing onto the front side of the printing sheet on which images are printed first in the double-sided printing mode.

Therefore, this embodiment is configured to reduce the amount of the pigmented ink in printing at least on the front side (namely, effecting printing onto the front side, or alternatively on both the front and the back sides) in the double-sided printing mode. For example, a possible configuration is to replace the pigmented ink with the dye inks in printing for a part of the side of the printing sheet, on which images are printed first, by otherwise using the pigmented ink. Specifically, some of those dots usually formed by the pigmented K ink are replaced with the dye ink dots (the dye black ink dots or the dye C-, M- and Y ink dots). In such application it is preferable to rearrange the dots in order to maintain the printing density.

Other Embodiments

In each of the above mentioned embodiments, there is described a form or mode in which an instruction of double-sided printing mode is performed on the printing apparatus, specifically, the form or mode in which an instruction of double-sided printing mode is performed through the input portion 105 on the printing apparatus, but the present invention is not limited to such a form or mode. For example, there can be used such a form or mode that an instruction of double-sided printing mode is performed through the UI (user interface) of the printer driver programmed in a host equipment 104 which is connected with the inkjet printing apparatus.

In the case of designating a double-sided printing mode through the UI (user interface) of the printer driver programmed in the host equipment 104, it is preferable for the host equipment 104 to create a data (the data enabling implementing the printing modes as described in the above mentioned first through sixth embodiments) which is applicable to a double-sided printing mode and then send the data to the inkjet printing apparatus. For example, when being applied to the first embodiment, data for the dye C-, M- and Y inks, instead of a pigmented K ink (the pigmented black ink), applicable to the black area for effecting printing onto the front side is created such that the front side is printed by using the dye color inks, in place of a pigmented black ink. Alternatively, when being applied to the fourth embodiment, data for the dye K ink (the dye black ink), instead of a pigmented K ink, applicable to the black area for effecting printing onto both the front and back sides is created so that both the front and back sides are printed by using only the dye ink, in place of a pigmented ink.

It is noted that, in the present invention, colors of the pigmented ink are arbitrary, without being limited to black as described in the above mentioned embodiments; such is also the case with colors of the dye inks as described in the above mentioned embodiments.

It is also noted that, in the present invention, it is possible to use plural inks, each containing a different amount of pigment, and use the one containing a smaller amount thereof for printing images on the side on which image is printed first in the double-sided printing mode. Further, it is possible to use the ink containing smaller amount of the pigment for effecting printing onto the side of the printing sheet, which is likely to be contact with peripheral devices, etc., after the printing thereon, not limited to the side on which image is printed first in the double-sided printing mode.

And the present invention is applicable not only to the serial scan type printing apparatuses as described above, but also broadly to various printing apparatuses such as the so-called full line type which has a printing head extending to the entire width of the printing area of printing medium. The present invention is also applicable widely to various printing apparatuses which use plural inks including at least one kind of a pigmented ink and at least one kind of a dye ink to print image on printing medium in plural printing modes including a double-sided printing mode.

And the present invention also includes an application in which a software program to implement the functions of the above mentioned embodiments (in the embodiments, a program for processes associated with the flow chart as indicated in FIGS. 3 and 4) is supplied to a system or a device directly or remotely, and a computer for the system or the device reads out the supplied program code and execute it. In this case a form or mode having such a program function does not have to be a program.

Accordingly, a program code itself installed in a computer by which functions of the present invention are implemented by the computer is also a means to implement the present invention.

In that case, a program form is arbitrary provided a program function is included therein, such as an object code, a program executed by interpreter, or a script data to be supplied to an OS.

A various memory medium to supply program code are available, for example: floppy (registered trade mark) disk, hard disk, optical disk, magneto optical disk, MO, CD-ROM, CD-R, CD-RW, magnetic disk, nonvolatile memory card, ROM, DVD (DVD-ROM, DVD-R).

Other program supplying method is possible by connecting the client computer to the Internet home page through a browser installed in the computer, and downloading the computer program which implements the function of the present invention in its original form or a compressed file with the automatic installation function attached therein from the home page onto the memory medium such as the hard disk. It is further possible by dividing the program codes comprising the program which implements the functions relating to the present invention into a plurality of computer files, and downloading each file from each different home page. In sum, the present invention also includes a World Wide Web server, which enables plural users to implement the functions relating to the present invention.

And it is possible to accomplish by distributing memory medium such as CD-ROM stored with an encrypted program relating to the functions of the present invention to the users, having the only users who clear a certain contract terms download the key information to decrypt it from the home page through the Internet so that the users decrypt the encrypted program by using the key information, install it in their computers, and thereby implement it.

The present invention of course includes a case in which, in addition to implementing the functions of the above mentioned embodiments by the computer executing the read-out program, the OS (operating system) or the equivalent operating in the computer executes either the entirety or a part of the actual process in compliance with the instruction of the program code, thereby implementing the functions of the above mentioned embodiments.

Further, the present invention of course includes a case in which, after the program code read out from a memory medium is installed in a function add-in board inserted in the computer or in the memory aboard a function extension unit connected thereto, the CPU or the equivalent aboard the function add-in board or the function extension unit executes either the entirety or a part of the actual process in compliance with the instruction of the program code, thereby implementing the functions of the above mentioned embodiments.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus capable of printing an image onto a printing medium by using both a pigmented ink containing a pigment and a dye ink containing a dye, comprising:

transporting means for transporting the printing medium; and printing control means capable of executing a single-sided printing mode effecting printing onto one side of the printing medium transported by said transporting means and a double-sided printing mode effecting printing onto both sides of the printing medium transported by said transporting means, wherein in the event of executing the double-sided printing mode, said printing control means effects printing onto at least one side on which the printing is effected first out of both sides of the printing medium by using the dye ink without using the pigmented ink, and wherein in the event of executing the single-sided printing mode, said printing control means effects printing onto a side of the printing medium by using both the pigmented ink and the dye ink.

2. A printing apparatus as claimed in claim 1, wherein in the event of executing the double-sided printing mode, said printing control means effects printing onto both sides of the printing medium by using only the dye ink without using the pigmented ink.

3. A printing apparatus as claimed in claim 1, wherein in the event of executing the double-sided printing mode, said printing control means subsequently effects printing onto the other side of the printing medium by using both the pigmented ink and the dye ink.

4. A printing apparatus as claimed in claim 1, wherein said printing control means effects printing onto both sides, or the side on which the printing is effected first, of the printing medium by using the dye ink for at least a part of the image which is supposed to be printed with the pigmented ink.

5. A printing apparatus as claimed in claim 4, wherein said printing control means effects printing by using a dye cyan ink, a dye magenta ink and a dye yellow ink for at least a part of the image which is supposed to be printed by using a pigmented black ink.

6. A printing apparatus as claimed in claim 4, wherein said printing control means effects printing by using a dye black ink for at least a part of the image which is supposed to be printed by using a pigmented black ink.

7. A printing apparatus as claimed in claim 1, wherein the pigmented ink includes black ink and the dye ink includes at least one of cyan, magenta, yellow and black inks.

8. A printing apparatus capable of printing an image on a printing medium by using both a pigmented ink containing a pigment and a dye ink containing a dye, comprising:

transporting means for transporting the printing medium; and printing control means capable of executing a single-sided printing mode effecting printing onto one side of the printing medium transported by said transporting means and a double-sided printing mode effecting printing onto both sides of the printing medium transported by said transporting means, wherein in the event of executing the double-sided printing mode, said printing control means effects printing onto at least a specific part of the side on which the printing is effected first, out of both sides of the printing medium, by using the dye ink without using the pigmented ink, and wherein in the event of executing the single-sided printing mode, said printing control means effects printing onto a side of the printing medium by using both the pigmented ink and the dye ink.

9. A printing method of printing an image onto a printing medium by using a printing unit capable of ejecting both a pigmented ink containing a pigment or a dye ink containing a dye, comprising the steps of:

a selection step in which a printing mode is selected from either a single-sided printing mode effecting printing onto one side of the printing medium using the printing unit or a double-sided printing mode effecting printing onto both sides of the printing medium using the printing unit;

a data creation step in which image data is created for printing onto at least the side of the printing medium on which the printing is effected first, out of both sides of the printing medium, by using the dye ink without using the pigmented ink when the double-sided printing mode is selected in said selection step, and in which image data is created for printing by using both the dye ink and the pigmented ink when the single-sided printing mode is selected in said selection step; and a printing step in which printing onto the printing medium using the printing unit is effected based on the image data created in said data creation step.

10. A printing method of printing an image on a printing medium by using a printing unit capable of ejecting both a pigmented ink containing a pigment and a dye ink containing a dye, comprising the steps of:

a selection step in which a printing mode is selected from either a single-sided printing mode effecting printing onto one side of the printing medium using the printing unit or a double-sided printing mode effecting printing onto both sides of the printing medium using the printing unit;

a data creation step in which image data is created for printing for at least a specific part of the side of the printing medium on which the printing is effected first, out of both sides of the printing medium, by using the dye ink without using the pigmented ink when the double-sided printing mode is selected in said selection step, and in which image data is created for printing by using both the dye ink and the pigmented ink when the single-sided printing mode is selected in said selection step; and a printing step in which printing onto the printing medium using the printing unit is effected based on the image data created in said data creation step.

11. A computer program product comprising a program stored on a computer-readable medium, said program being capable of executing in a computer to create image data to be supplied to a printing apparatus capable of printing an image onto a printing medium by using both a pigmented ink containing a pigment and a dye ink containing a dye, wherein said program includes a data creation step in which data is created in response to a printing mode selected out of a single-sided printing mode effecting printing onto one side of the printing medium and a double-sided printing mode effecting printing onto both sides of the printing medium, and in said data creation step, image data is created for printing onto at least the side on which the printing is effected first out of both sides of the printing medium by using the dye ink without using the pigmented ink when the double-sided printing mode is selected and image data is created for printing onto a side of the printing medium by using both the dye ink and the pigmented ink when the single-sided printing mode is selected.

12. A computer program product comprising a program stored on a computer-readable medium, said program being capable of executing in a computer to create image data to be supplied to a printing apparatus capable of printing an image onto a printing medium by using both a pigmented ink containing a pigment and a dye ink containing a dye, wherein said program includes a data creation step in which data is created in response to a printing mode selected out of a single-sided printing mode effecting printing onto one side of the printing medium and a double-sided printing mode effecting printing onto both sides of the printing medium, and in said data creation step, image data is created for printing for at least a specific part of the side on which the printing is effected first of the printing medium by using only the dye ink without using the pigmented ink when the double-sided printing mode is selected and image data is created for printing onto a side of the printing medium by using both the dye ink and the pigmented ink when the single-sided printing mode is selected.

13. A printing apparatus, comprising:

a printing unit capable of ejecting both a pigmented ink containing a pigment and a dye ink containing a dye onto a printing medium; and a printing controller capable of executing a single-sided printing mode for printing onto one side of the printing medium by ejecting both the pigmented ink and the dye ink from said printing unit and a double-sided printing mode for printing onto both sides of the printing medium by ejecting the dye ink without ejecting the pigmented ink from said printing unit.

14. A printing method of printing onto a printing medium by using a printing unit capable of ejecting both a pigmented ink containing a pigment and a dye ink containing a dye, the method comprising the steps of:

setting a single-sided printing mode for printing onto one side of the printing medium by ejecting both the pigmented ink and the dye ink from the printing unit or a double-sided printing mode for printing onto both sides of the printing medium by ejecting the dye ink without ejecting the pigmented ink from the printing unit; and printing onto the printing medium according to the set printing mode.

* * * * *

UNITED STATES PATENT AND TRADEMARK OFFICE

CERTIFICATE OF CORRECTION

PATENT NO. : 7,311,368 B2
APPLICATION NO. : 10/885585
DATED : December 25, 2007
INVENTOR(S) : Kawakami It is certified that error appears in the above-identified patent and that said Letters Patent is hereby corrected as shown below:

COLUMN 2:
Line 9, “of in” should read --off in--.
Line 14, “tend” should read --tends--.
Line 15, “rubbed off” should read --rubbing off--.

COLUMN 3:
Line 49, “with limiting” should read --while limiting--.

COLUMN 4:
Line 4, “with limiting” should read --while limiting--.
Line 16, “printing” should read --a printing--.

COLUMN 5:
Line 13, “including” should read --includes--.

COLUMN 6:
Line 28, “adopt” should read --be adopted--.

COLUMN 7:
Line 21, “on a” should read --on an--.

COLUMN 8:
Line 28, “in more specific,” should read --more specifically,--.
Line 51, “power on” should read --power--.
Line 52, “printing more” should read --printing mode--.

COLUMN 9:
Line 30, “are” should read --is--.
Line 47, “sheet 2 it is” should read --sheet 2; it is--.

COLUMN 10:
Line 47, “is likely” should read --are likely--.
Line 49, “with.” should read --therewith.--.
Line 50, “noted that made” should be deleted.

UNITED STATES PATENT AND TRADEMARK OFFICE

CERTIFICATE OF CORRECTION

PATENT NO. : 7,311,368 B2
APPLICATION NO. : 10/885585
DATED : December 25, 2007
INVENTOR(S) : Kawakami It is certified that error appears in the above-identified patent and that said Letters Patent is hereby corrected as shown below:

COLUMN 11:
Line 15, “tend” should read --tends--.
Line 34, “user needs” should read --user’s needs--.

COLUMN 12:
Line 2, “are similar” should read --similar--.

COLUMN 13:
Line 7, “first, fourth and” should read --first and fourth--.

COLUMN 14:
Line 11, “smaller” should read --a smaller--.
Line 13, “be contact” should read --be in contact--.
Line 34, “execute” should read --executes--.
Line 44, “A various” should read --Various--, and “medium” should read --media--.
Line 63, “accomplish” should read --accomplish this--.
Line 66, “a certain” should read --certain--.

Signed and Sealed this

Seventeenth Day of March, 2009

JOHN DOLL
*Acting Director of the United States Patent and Trademark Office*